US005621445A

United States Patent [19]

Fong et al.

[11] Patent Number: 5,621,445

[45] **Date of Patent: *Apr. 15, 1997**

[54] APPARATUS FOR REFILLING INK CARTRIDGES

[75] Inventors: Jon Fong; David S. Hunt, both of San Diego; Michael L. Borer, Oceanside, all of Calif.

[73] Assignee: Hewlett-Packard Company, Palo Alto, Calif.

[ * ] Notice: The term of this patent shall not extend beyond the expiration date of Pat. No. 5,280,300.

[21] Appl. No.: 322,848

[22] Filed: Oct. 13, 1994

Related U.S. Application Data

[63] Continuation-in-part of Ser. No. 171,321, Dec. 21, 1993, abandoned, which is a continuation of Ser. No. 750,360, Aug. 27, 1991, Pat. No. 5,280,300.

[51] Int. Cl.[6] ..... B41J 2/175

[52] U.S. Cl. ..... 347/87

[58] Field of Search ..... 347/86, 87; 141/2, 141/18, 98; 222/95, 422; 137/614, 614.05, 614.06; 285/9.2, 13, 14

[56] References Cited

U.S. PATENT DOCUMENTS 5,280,300 1/1994 Fong et al. ..... 347/87

*Primary Examiner*—Benjamin R. Fuller
*Assistant Examiner*—L. Anderson

[57] ABSTRACT

The invention generally relates to refillable ink cartridges for computer controlled ink jet printers and, more specifically, to apparatus for refilling collapsible ink bags which are maintained at sub-atmospheric pressure within such equipment. The refilling apparatus includes a fluid bridge located between the reservoir holding replenishment ink and the ink cartridge. The fluid bridge may contain either a purge valve and/or a priming valve that prevent air bubbles from being introduced into the ink bag and from obstructing the flow of replenishment ink.

6 Claims, 5 Drawing Sheets

APPARATUS FOR REFILLING INK CARTRIDGES

CROSS REFERENCES TO RELATED APPLICATIONS

This application is a continuation-in-part of application Ser. No. 08/171,321 filed Dec. 21, 1993 , now abandoned, which is a continuation of Ser. No. 750,360, now U.S. Pat. No. 5,280,300 filed Aug. 27, 1991.

BACKGROUND OF THE INVENTION AND PRIOR ART

The invention relates generally to ink cartridges for computer controlled printers and, more specifically, to apparatus for refilling collapsible ink bags within such cartridges.

Computer-controlled printers are well known and replaceable pen and ink cartridges for such printers are likewise well known. These cartridges contain an ink reservoir bag which is maintained at sub-atmospheric pressure to minimize the likelihood of ink inadvertently leaking therefrom. One such printer and the ink cartridges for it are described in Hewlett-Packard Journal, February 1994, Volume 45, Number 1.

The ink delivering nozzle of the cartridge assembly normally remains primed by ink so that it is ready to print on demand and remains so as ink is withdrawn. The ink bag progressively collapses as ink is expelled therefrom. Depriming of the nozzle occurs substantially only when the ink volume is exhausted.

One example of a prior art ink replenishment system includes a double-septum needle (nozzle) arrangement which requires a number of parts and which is therefore comparatively expensive to manufacture. A dual mechanical valving set-up as found on compressed gas cylinders has also been used as have three way valves. All of these prior art techniques for ink replenishment are relatively complex, expensive and bulky.

The manner in which the invention deals with the prior art disadvantage to produce a novel and advantageous new combination will be evident as this specification proceeds.

SUMMARY OF THE INVENTION

The general purpose of the invention is to introduce a fluid into a closed, negative pressure, fluid container without also introducing air or other gases. More particularly, the invention was developed to refill an ink cartridge having a collaspible ink bag.

The present invention provides an apparatus for refilling an ink cartridge for a printer from a reservoir holding replenishment ink. A fluid bridge is connected between the reservoir and an ink bag within the ink cartridge so that replenishment ink may be transferred from the reservoir to the ink bag. The fluid bridge may include a gas purge valve for removing gases from the bridge that may obstruct the flow of replenishment ink. The fluid bridge may also include an ink priming valve for establishing contiguous liquid communication between the reservoir and the ink bag. The present invention also provides a deformable grommet located in the side wall of the ink cartridge and fluid communication with the ink bag. The grommet forms one portion of a self-sealing, self-purging, and self-priming fluid bridge between the ink replenishment reservoir and the ink cartridge.

The details of the preferred embodiments of the invention will be evident as this description continues. The capillary valve is inexpensive, has no moving parts and prevents air flow therethrough and also prevents ink flow therethrough unless both sides of the valve are in contact with liquid.

DESCRIPTION OF THE PREFERRED EMBODIMENT

Ink cartridges in the past have generally been designed to be non-refillable and to be discarded when the ink is depleted. As stated herein, the invention concerns an apparatus for refilling ink cartridges so that these cartridges may be reused again and again.

Figure 1:
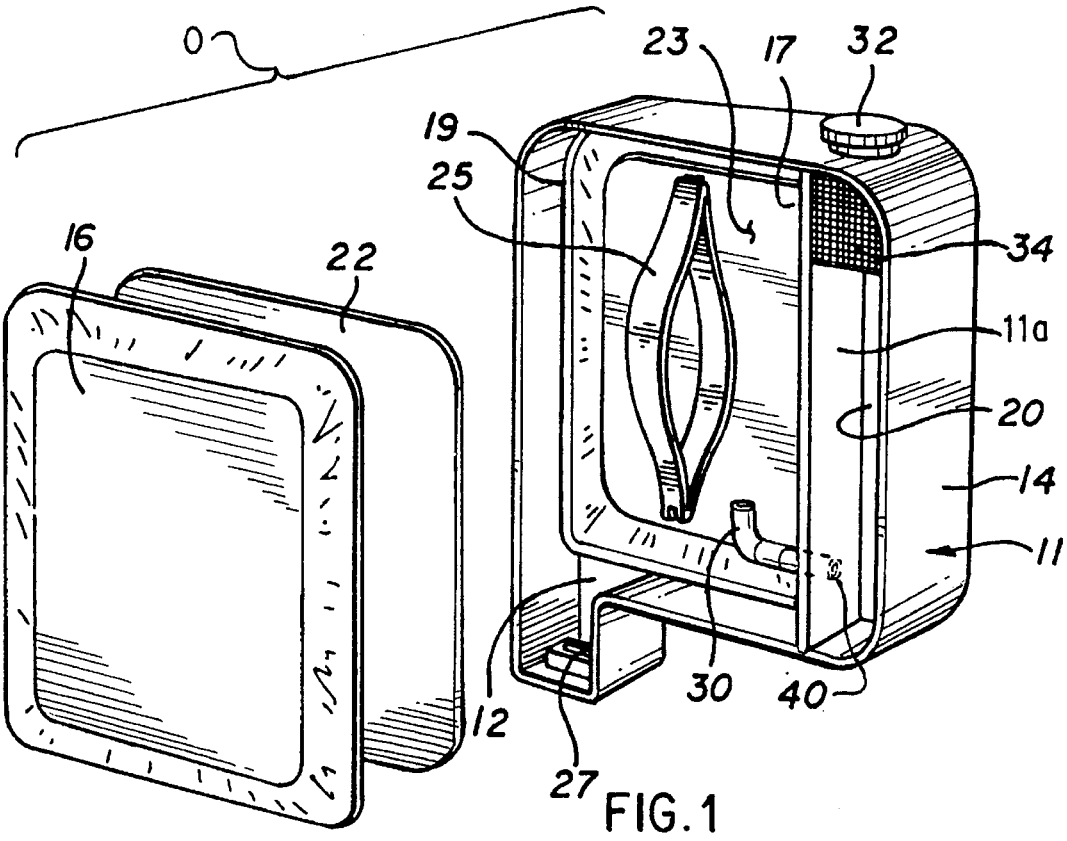
FIG. 1 is an exploded perspective view of a printer ink cartridge including an internally disposed ink bag and refilling chamber with a capillary valve therebetween.

FIG. 1 shows an ink cartridge 10 for a printer comprised of a housing 11 having a pair of parallel side walls 12, only one of which is shown, a rigid peripheral wall 14 containing a collapsible ink bag 15 and an ink reserve chamber 20 therein. The bag 15 is comprised of a pair of rectangular flexible side panels 16, 17 secured together at their periphery and secured to the peripheral wall 14 of the housing as seen at 19. Bag 15 includes a pair of spaced apart, relatively non-deformable, lightweight metal plates 22, 23 therein which are urged apart from each other into engagement with the flexible side panels 16, 17 by a double bowed metal spring 25. The spring urges the plates apart and thereby expands the collapsible bag 15.

Ink from the bag 15 is discharged, as is known in the art, by a head (not shown) mounted inside housing 11 through an ink jet orifice (nozzle) or an arrangement of orifices in a printer nozzle plate indicated generally by reference numeral 27.

The ink cartridge housing 11 has a divider wall **11*a* therein to one side of the ink bag 15 thereby defining a refillable ink reserve chamber 20 in the housing. The ink reserve chamber is connected by a fluid conduit 30 to the flexible ink bag 15. A screw cap 32 covers a fill aperture which extends through the peripheral wall 14 of the housing into fluid communication with the ink refill chamber 20. A foam spray dampener mesh 34** is provided below the fill aperture to prevent any backsplash of fluid during replenishment of the ink supply in the ink reserve chamber.

A capillary valve 40 comprised of a cylindrical block of capillary filter material is disposed in the fluid conduit 30 extending between the ink bag 15 and the ink reserve chamber 20. The valve 40 governs the flow of ink through the conduit 30. The capillary filter material may be fabricated from any ink compatible material which has an effective capillary force greater than the capillary force of the printer nozzle plate 27, FIG. 2. The capillary valve filter material preferably comprises a high dirt capacity stainless steel woven wire mesh. One such filter material is sold under the trademark RIGIMESH by Pall Process Filtration Company of East Hills, N.Y. A RIGIMESH Type J sintered woven wire mesh filter having a nominal filter rating of ten and an absolute rating of twenty-five in liquids is presently preferred. The capillary valve readily passes ink from the reserve chamber 20 to the collapsible bag 15 which is maintained under sub-atmospheric or negative pressure by the action of the double bowed spring 25, FIG. 1. In other words, the pressure in the spring bag 15 is maintained at a lower pressure than the pressure in the reserve chamber 20 so that ink is automatically drawn into the ink bag from the reserve chamber 20 through the capillary valve 40 in the conduit 30.

The properties of the capillary filter material are such that it readily passes ink when both its inlet surface and its outlet surface are wetted with ink; however, the filter also acts as a valve to prevent the flow of ink or air in either direction through the filter whenever the inlet side of the valve 40 is no longer in a wetted condition. That is to say, when the ink supply in the reserve chamber 20 is exhausted, the valve 40 shuts. Thereafter, the ink remaining in the ink bag 15 is discharged through the nozzle plate 27 during operation of the printer until the ink supply is completely exhausted.

Such an arrangement of ink bag, reservoir, connecting conduit and valve has the advantage that the ink supply in the flexible bag 15 need not be directly monitored and the possible inadvertant introduction of gases into the bag thereby is avoided. It being a rather simple matter to periodically remove the fill cap 32 and replenish the ink supply in the ink reserve chamber 20. A transparent window or sight gauge may be provided so that the ink level in the reserve chamber 20 can be visually monitored.

Figure 2:
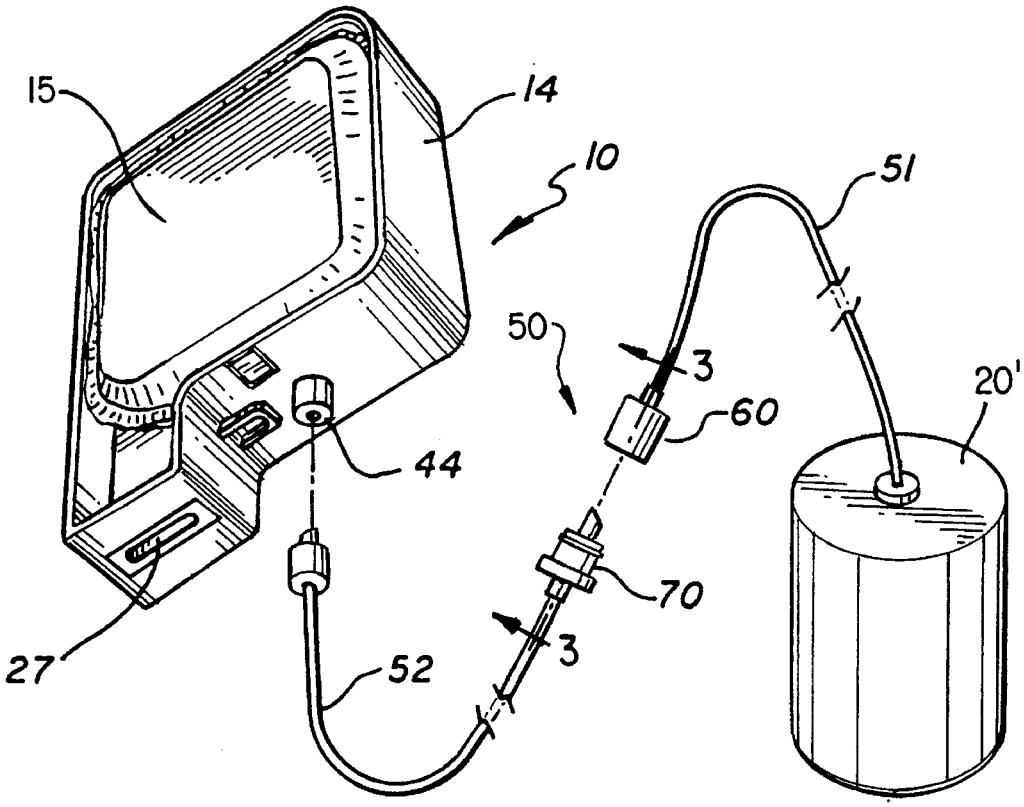
FIG. 2 is a diagrammatic perspective view showing an alternative means for refilling the negative pressure ink bag from a remote refilling container of ink by the use of a fluid bridge.

Turning now to FIG. 2, this alternative embodiment is much the same as the embodiment of FIG. 1 except that the ink reserve chamber 20, FIG. 1 is not contained within the walls of the housing of the printer ink cartridge 10. Instead, an ink reserve chamber 20' filled with replenishment ink, which is also maintained at sub-atmospheric pressure by means not shown (so that ink will not leak from the remote chamber), is connectable to refill the spring biased ink bag 15 in the cartridge housing by means of a novel fluid bridge. The fluid bridge employs a capillary valve similar to that used in the embodiment of FIG. 1. Specifically, the filling arrangement comprises a two-part filling tube 50 having a mating female coupler 60 on one part 51 of the tube and a male coupler 70 on the end of the other part 52 of the tube to be joined therewith. The remote ends of the two tubes are respectively connectable to the remote ink reserve chamber 20' and to a self-sealing connector 44 disposed on the peripheral wall 14 of the cartridge housing.

Referring now to FIGS. 3, 4, 5 and 6, the fluid bridge is shown in connecting, air purging, ink priming/delivery and disconnect stages, respectively. In these figures, the female and male parts 60 and 70 of the fluid bridge are seen to comprise respectively a cylinder portion 62 which is connectable to the ink supply tube 51 and a piston portion 72 which is connectable to the ink delivery tube 52. Both cylinder and the piston portions have axially aligned ink supply and delivery passageways 64 and 74 therethrough. Capillary filters 66, 76, preferably fabricated of RIGIMESH like filter 40, FIG. 1, are provided in the ink supply and ink delivery passageways at the locations shown.

Figure 3:
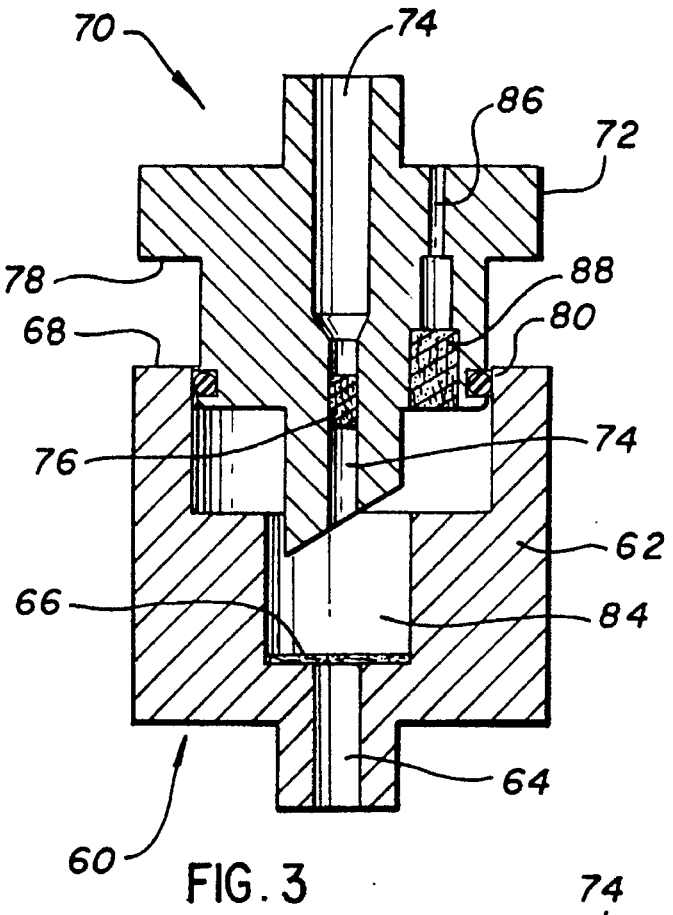
FIG. 3 is a cross-sectional view taken along line 3—3 of FIG. 2 of the fluid bridge, illustrating its construction and a first connecting step in its operation.
Figure 4:
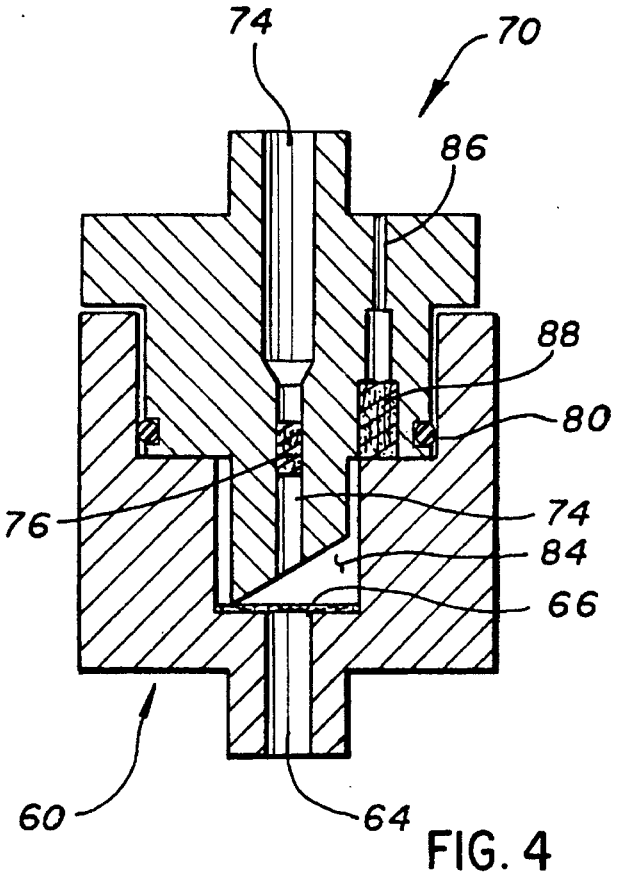
FIG. 4 is a cross-sectional view of the fluid bridge of FIG. 3 showing a second step in its operation for purging air from its interior passages.
Figure 5:
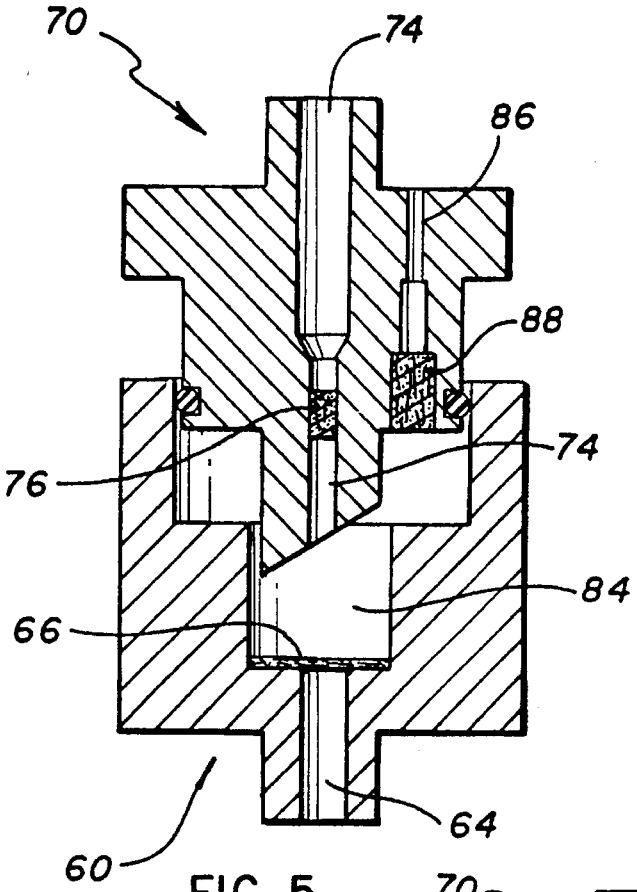
FIG. 5 is a cross-sectional view of the fluid bridge of FIG. 3 illustrating a third step for establishing contiguous liquid communication.

The piston portion 72 is slidable inwardly within the bore of cylinder portion 62, until shoulders 68, 78 disposed on the piston and cylinder portions come into abutment as shown in FIG. 4. The piston is slideably sealed in the cylinder by O-ring 80 located in a groove on the piston 72. As shown in FIG. 3, it will be realized that air is entrapped in the space 84 between the two portions. When the piston 72 is depressed downward into cylinder 62 (or the cylinder is pushed upward), the entrapped air in space 84 is forced through a vent passage 86. An enlarged portion of this passage contains a filter 88 that permits the flow of air and which prevents the flow of ink upwardly therethrough during the priming and ink transfer steps. Our presently preferred material for filter 88 is a sintered Teflon material sold under the trade name POREX. A further material suitable for filter 88 is a breathable waterproof fabric such as GORE-TEX which is manufactured by W. L. Gore & Associates, Inc. of Elkton, Md.

After the air is purged (FIG. 4), the piston portion 72 is then partially withdrawn from the cylinder portion 62 (FIG. 5) thus drawing ink into space 84 and creating a fluid bridge across capillary filters 66 and 76 whereby ink now continuously flows from the negative pressure, remote ink reserve chamber 20' to the spring-biased ink bag 15 which is maintained at an even lower negative pressure by the spring 25.

Figure 6:
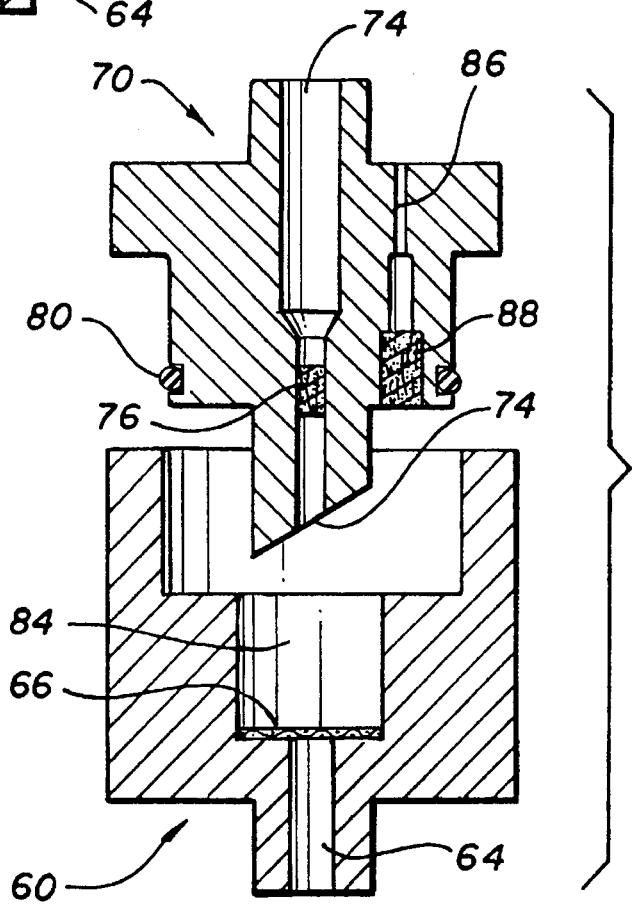
FIG. 6 is a cross-sectional view of the fluid bridge of FIG. 3 illustrating a fourth step for disconnecting the fluid bridge after the ink bag refill.

When the refilling of the ink bag 15 is accomplished, the piston portion 72 is withdrawn as illustrated in FIG. 6. Capillary filter 76 in the delivery passageway 74 has its lower end now exposed to air so that the filter and the negative pressure in the ink bag 15 together prevent the leakage of ink back out the delivery tube 52. Any residual ink which has drained into space 84 passes through the capillary filter 66 (since both sides thereof are wetted), then through the ink supply tube 51 and back into the ink reserve chamber 20'.

At this time, refilling has been completed, and the ink delivery tube 52, FIG. 2 can be disconnected from the ink cartridge 10. A capillary filter can also be provided in the liquid passageway in the cartridge 10 between the delivery tube inlet connector 44 and the ink bag 15 to seal the connector 44.

Figure 7:
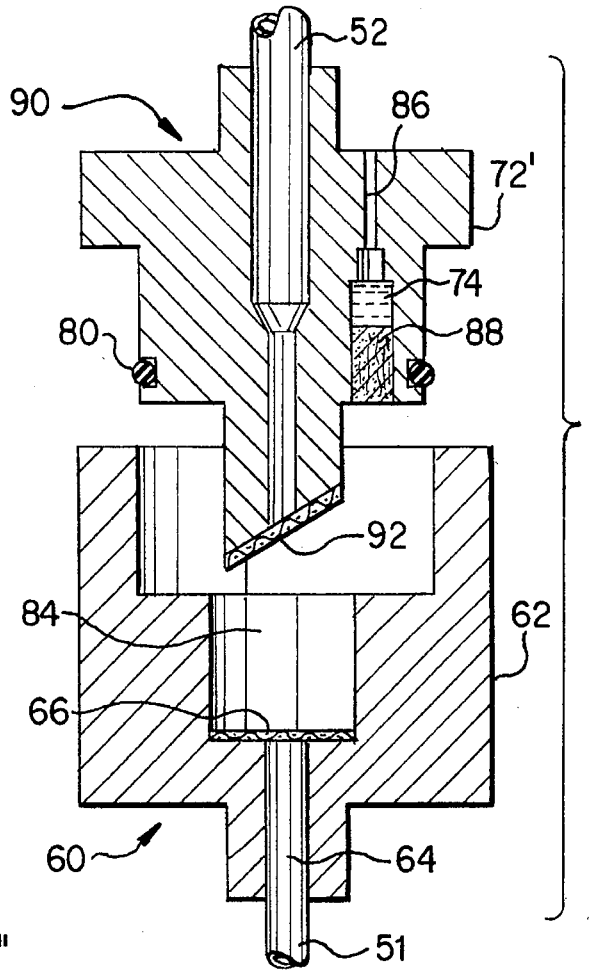
FIG. 7 is a side elevational view in cross section of an alternative embodiment of the fluid bridge of the present invention.

Referring to FIG. 7, reference numeral 90 generally indicates an alternative embodiment of the present invention. This embodiment includes a cylinder portion 62 and a piston portion 72' that are received together to form a fluid bridge. The fluid bridge is connectible between the reservoir 20', FIG. 2 and the collapsible ink bag 15, FIG. 2 by the ink supply tube 51, FIG. 2 and the ink delivery tube 52. The fluid bridge mechanically and fluidically couples the ink reservoir to the ink bag so that replenishment ink may be transferred from the reservoir to the ink bag. The cylinder portion 62 operates in the same manner as the cylinder portion 62 described above in FIGS. 3–6, inclusive. The piston portion 72' includes a capillary filter 92 mounted on the inclined central surface of the end wall of the piston portion. The capillary filter covers the ink delivery tube 52 and operates in the same manner as a capillary filter 76 described above in connection with FIGS. 3–6. The inclined central surface of the end wall of the piston prevents the capture of air bubbles or other gases within the fluid bridge when the piston 72' and the cylinder portion 62 are brought together.

Referring to FIG. 7, reference numeral 74 generally indicates a quantity of water or other low vapor pressure liquid located within the vent passage 86 on top of the filter 88. The filter and the water 74 together operate to pass air bubbles or their gases through the vent passage 86 when the cylinder portion 62 and the piston 72' are brought together and air and other gases are purged from the interior space 84 of the fluid bridge. The filter 88 also prevents the passage of ink from the interior space 84, FIG. 4 into the vent passage 86.

When the cylinder portion 62, FIG. 7 is brought into fluid and mechanical connection with the piston 72, a fluid bridge is formed. The fluid bridge includes a gas valve for purging the air bubbles and other gases from the bridge that may obstruct the flow of replenishment ink from the reservoir 20' to the ink bag. This purge valve is formed by the piston 72 sliding inwardly within the bore of the cylinder portion 62 so that the entrapped air in the space 84 is forced through the vent passage 86. The purge valve also includes the filter 88 and the water 74 which together pass the air and dissolved gases but block the passage of replenishment ink.

The fluid bridge also contains a priming valve that establishes contiguous liquid communication between the reservoir and the ink bag. When the piston and the cylinder are brought together, the air entrapped in the space 84 is exhausted in the vent passage 86. Simultaneously, the capillary filters 66 and 92 permit the flow of ink across their surfaces when both sides of the filters are wetted. The combined operation of the cylinder portion 62, and the piston 72, and the filters 66, 76, 88, and 92 ensures that when the fluid bridge is established, the bridge is primed with ink to establish contiguous liquid communication between the reservoir 20' and the ink bag.

It is contemplated that perhaps one closing stroke of the cylinder portion 62, FIG. 7 and the piston 72 may not be sufficient to fully purge all of the air bubbles and gases from the fluid bridge or to prime completely the entire fluid bridge. If so, then the cylinder and piston may be moved in reciprocal strokes with respect to each other in a pumping process until the fluid bridge is fully primed and purged.

Figure 8:
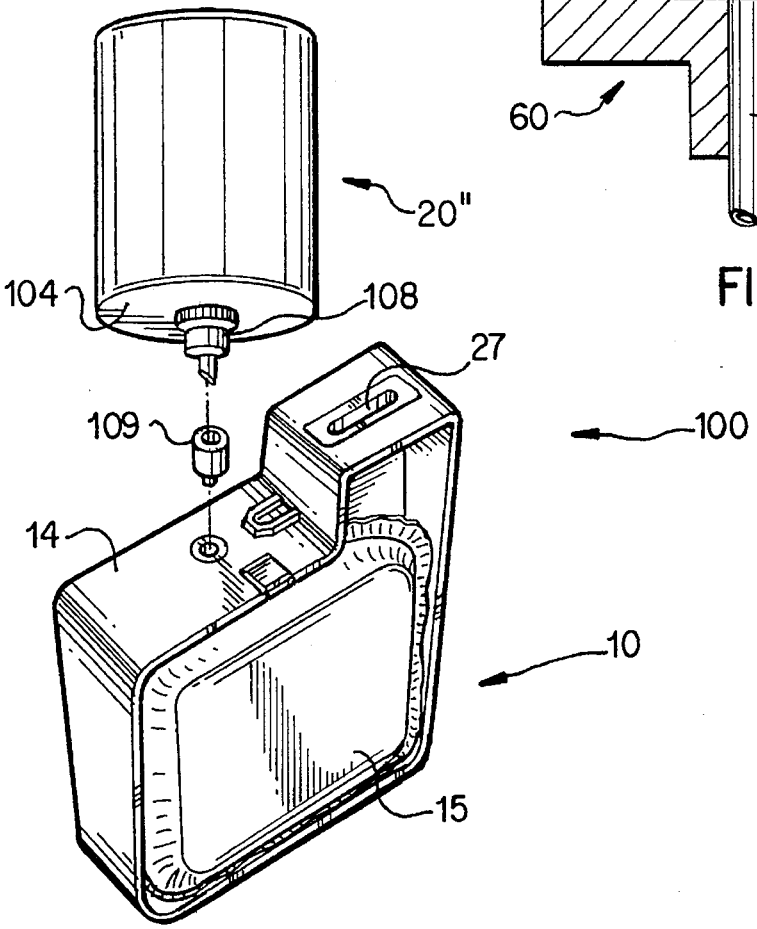
FIG. 8 is a perspective view of a second alternative embodiment of the present invention.
Figure 9:
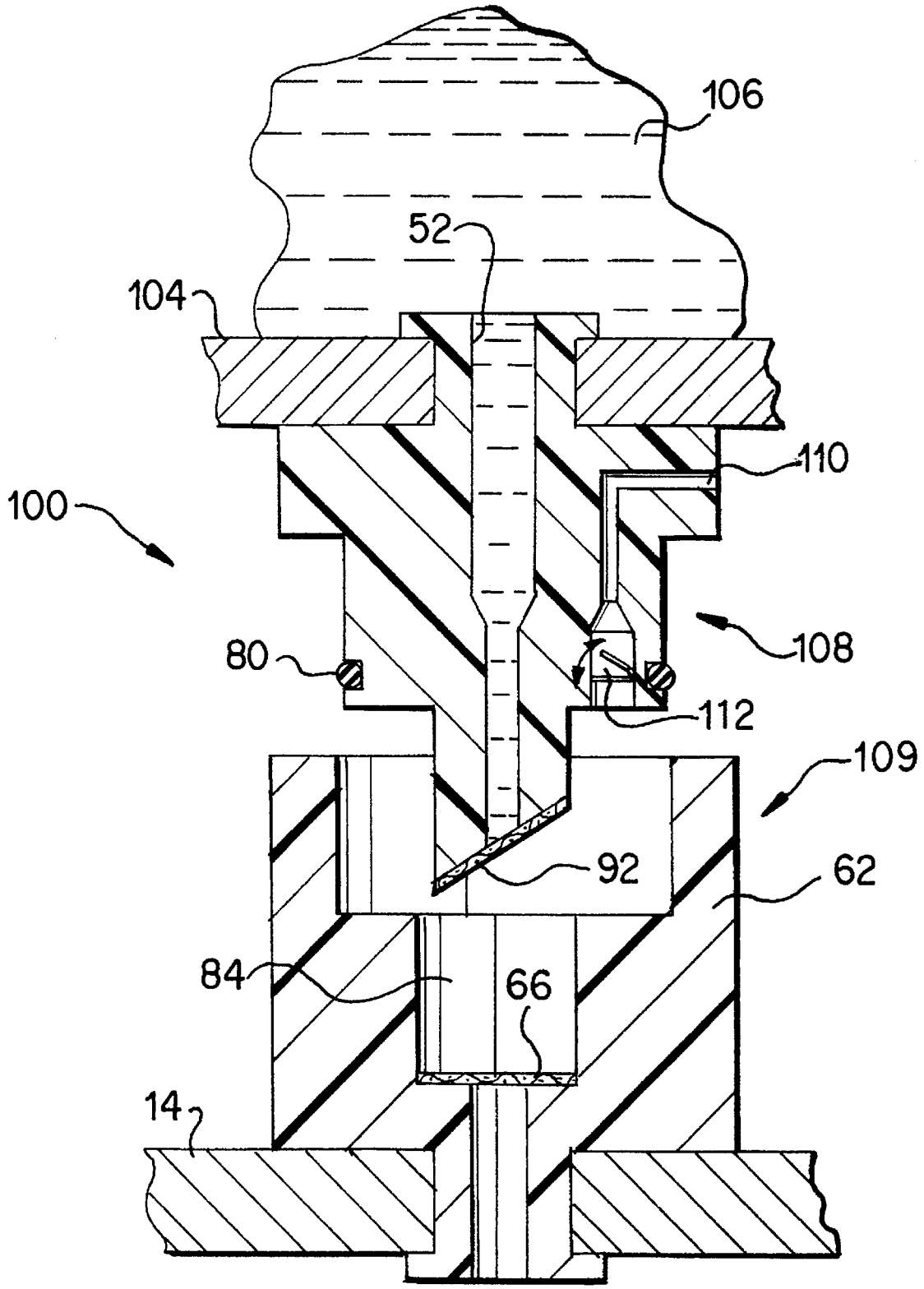
FIG. 9 is a side elevation view in cross section of the fluid bridge of FIG. 8.

Referred to FIGS. 8 and 9, reference numeral 100 generally indicates a second alternative embodiment of the present invention. This embodiment includes a reservoir 20" for holding replenishment ink and an ink cartridge 10 having a rigid housing 14 and a collapsible ink bag 15 within the housing. The reservoir 20" has an end wall 104, FIGS. 8 and 9 and contains replenishment ink 106, FIG. 9 for refilling the ink cartridge 10.

Referring to FIGS. 8 and 9, reference numeral 108 indicates a male/piston portion of the fluid bridge. The piston portion 108 is received in the end of wall 104 of the reservoir and forms a fluid-tight seal. Further, the piston portion of the fluid bridge also includes an O-ring 80, a capillary filter 92 located on the inclined central surface of the piston portion and an ink delivery tube 52 as described herein above. The piston portion further includes a purging vent 110 that creates a passage way for air bubbles and other gases to escape from the fluid bridge when the two portions of the bridge are brought together. The purging vent 110 has a mechanical valve 112 near its inlet. The mechanical valve opens as the two portions of the fluid bridge are brought together to allow air bubbles and gases to escape from a space 84 and then shuts to prevent the passage of ink up the vent 110 and out to the atmosphere.

The fluid bridge illustrated in FIGS. 8 and 9 includes a second female/cylindrical portion 62. This second portion operates in the same manner as the cylinder portion 62 described above in connection with FIGS. 3–6. The female/cylindrical portion of the fluid bridge is received in the rigid housing 14 of the ink cartridge and forms a fluid-tight seal.

The structural elements of the fluid bridge and its conduits may be constructed of common materials such as polyethylene or similar as long as the material is resistant to the chemicals of the ink.

Referring to FIGS. 8 and 9, the ink cartridge 10 is refilled with replenishment ink 106 by first inserting the female/cylindrical portion 109 of the fluid bridge into the rigid side wall of the housing of 14 of the ink cartridge. This female/cylindrical portion forms a leak-tight seal between the ink and the atmosphere and is in fluid communication with the ink bag of 15. Next, the male/piston portion 108 of the fluid bridge which is attached to the ink reservoir 20" is inserted into the cylindrical portion 109. During this step the air bubbles and gases within the fluid bridge are expelled through the purging vent 110 as described above in connection with FIGS. 3–6. After the bubbles and gases have been removed, the mechanical valve 112 shuts and the space 84 that remains is filled with ink. Thereafter, the capillary valves 66, 92 establish fluid communication between the reservoir 20" and the ink bag 15 and the transfer of replenishment ink is commenced.

The flow of replenishment ink will stop when either the ink bag 15 is full, the reservoir 20" is empty, or the pressure between them has equalized. At that point the fluid bridge is separated in reverse of the procedure described above and the valves 66, 92 act to prevent the spillage of ink.

Thus, the fluid bridge of the present invention is self-sealing, self-purging and self-priming. Also during the process of refilling any air bubbles or gases that may be present will be removed from the fluid bridge so that there will be no obstructions to the flow of replenishment ink and no air bubbles or gases will be introduced into the ink bag.

Although specific embodiments of the invention have been described and illustrated, the invention is not to be limited to the specific forms or arrangements of parts so described and illustrated. The invention is limited only by the claims.

We claim:

1. Apparatus for refilling an ink cartridge for a printer, comprising:

a) an ink cartridge having a rigid housing, a collapsible ink bag within said housing, a spring also within the housing for urging the collapsible ink bag apart and thereby maintaining a sub-atmospheric pressure within the bag and means, in fluid communication with the ink bag, for ejecting droplets of ink on command from the cartridge;

b) a reservoir for holding replenishment ink;

c) a fluid bridge mechanically and fluidically connectable between the reservoir and the ink bag so that replenishment ink may be transferred from the reservoir to the ink bag; and d) a gas purge valve within the fluid bridge for removing gases from the bridge that may obstruct the transfer of replenishment ink from the reservoir to the ink bag.

2. Apparatus as in claim 1 wherein the fluid bridge further includes an ink priming valve within the fluid bridge for filling the bridge with ink and thereby establishing contiguous liquid communication between the reservoir and the ink bag.

3. Apparatus for refilling an ink cartridge for a printer, comprising:

a) an ink cartridge having a rigid housing, a collapsible ink bag within said housing, a spring also within the housing for urging the collapsible ink bag apart and thereby maintaining a sub-atmospheric pressure within the bag and means, in fluid communication with the ink bag, for ejecting droplets of ink on command from the cartridge;

b) a reservoir for holding replenishment ink;

c) a fluid bridge mechanically and fluidically connectable between the reservoir and the ink bag so that replenishment ink may be transferred from the reservoir to the ink bag; and d) an ink priming valve within the fluid bridge for filling the bridge with ink and thereby establishing contiguous liquid communication between the reservoir and the ink bag.

4. Apparatus as in claim 3 wherein the ink priming valve is a capillary valve having an inlet surface and an outlet surface of an ink compatible material which permits liquid flow through the capillary valve only when said inlet and outlet surfaces of the valve are both wetted.

5. Apparatus for refilling an ink cartridge for a printer, said ink cartridge having a rigid housing, a collapsible ink bag within said housing, a spring also within the housing for urging the collapsible ink bag apart and thereby maintaining a sub-atmospheric pressure within the bag and means, in fluid communication with the ink bag, for ejecting droplets of ink on command from the cartridge, comprising:

a) a reservoir for holding replenishment ink, said reservoir having a first fluid bridge portion connectable to a second fluid bridge portion on an ink cartridge, forming a fluid bridge between the reservoir and ink cartridge; and b) a gas purger on said first fluid bridge portion for establishing contiguous liquid communication between the reservoir and the ink cartridge.

6. Apparatus for refilling an ink cartridge with replenishment ink, said ink cartridge having a housing with rigid sidewalls, a collapsible ink bag within said housing, a spring also within the housing for urging the collapsible ink bag apart and thereby maintaining a sub-atmospheric pressure within the bag and means, in fluid communication with the ink bag, for ejecting droplets of ink on command from the cartridge, comprising:

a deformable cylinder locatable in a rigid sidewall of the ink cartridge and in fluid communication with the ink bag, said cylinder forming one portion of a self-sealing, self-purging, and self-priming fluid bridge between an ink replenishment reservoir and the ink cartridge, said fluid bridge being self-sealing, self-purging, and self-priming so that during refilling any gases that may obstruct the flow of replenishment ink may be removed from the fluid bridge and so that during refilling gases are not introduced into the ink bag.

* * * * *